US005836250A

United States Patent [19]

Herrmann et al.

[11] Patent Number: 5,836,250

[45] Date of Patent: Nov. 17, 1998

[54] DEVICE AND METHOD TO CLEAN CYLINDER SURFACES IN ROTARY PRINTING PRESSES

[75] Inventors: Joachim Herrmann, Mannheim; Kurt Lötsch, Wiesenbach; Ralf Degner, Heidelberg; Hendrik Stemmler, Wiesloch, all of Germany

[73] Assignee: Heidelberger Druckmaschinen Aktiengesellschaft, Heidelberg, Germany

[21] Appl. No.: 854,233

[22] Filed: May 9, 1997

[30] Foreign Application Priority Data

May 11, 1996 [DE] Germany ..... 196 19 143.2

[51] Int. Cl.[6] ..... B41F 35/00

[52] U.S. Cl. ..... 101/483; 101/424; 101/425

[58] Field of Search ..... 101/483, 424, 101/425

[56] References Cited

U.S. PATENT DOCUMENTS

| | | | |
|---|---|---|---|
| 2,525,982 | 10/1950 | Wescott | 101/425 |
| 3,094,068 | 6/1963 | Gericke | 101/425 |
| 3,422,758 | 1/1969 | Brewster | 101/425 |
| 4,344,361 | 8/1982 | MacPhee et al. | 101/425 |
| 5,509,353 | 4/1996 | Aoki | 101/425 |
| 5,519,914 | 5/1996 | Egan | 101/425 |

FOREIGN PATENT DOCUMENTS

| | | |
|---|---|---|
| 1611191 | 11/1970 | Germany . |
| 2804801 | 8/1979 | Germany . |

*Primary Examiner*—Edgar S. Burr
*Assistant Examiner*—Amanda B. Sandusky
*Attorney, Agent, or Firm*—Nils H. Ljungman and Associates

[57] ABSTRACT

A device to clean an outer cylindrical surface of a cylinder in a rotary printing press includes a cleaning cloth. The cleaning cloth can be pressed against the cylinder surface and is wound off a supply roller. To increase the effectiveness of the cleaning action, the cleaning cloth is wetted with a cleaning fluid upstream of the cylinder. The cleaning fluid can be fed via a feed tube to an absorbent wetting pad to uniformly distribute the cleaning fluid over the width of the cleaning cloth.

15 Claims, 4 Drawing Sheets

DEVICE AND METHOD TO CLEAN CYLINDER SURFACES IN ROTARY PRINTING PRESSES

BACKGROUND OF THE INVENTION

1. Field of the Invention

The present invention relates generally to a device to clean the cylindrical surface of a cylinder in a rotary printing press. A cleaning cloth can be pressed against the cylinder surface, and the cleaning cloth can also be paid off a supply roller. To improve the effectiveness of the cleaning action, the cleaning cloth can be wetted with a cleaning fluid, which cleaning fluid can be fed via a cleaning agent storage mechanism.

2. Background Information

A known device is disclosed in U.S. Pat. No. 2,525,982. A wick which has a metal support body in its interior is used to press the cleaning cloth against the cylindrical surface of the cylinder to be cleaned. To deposit the cleaning fluid on the wick, a housing is necessary to feed the cleaning fluid. When this device is used, there is a risk that too much cleaning fluid will be deposited when the wick is pressed against the cleaning cloth.

Another known device is disclosed in German Patent No. 16 11 191 A1. It also uses a cleaning agent storage mechanism made of spongy material, which spongy material is immersed in the cleaning fluid. Using this cleaning agent storage mechanism, a large quantity of fluid is transferred to a roller and removes the particles of dirt from the roller. The result is that the pores of the cleaning agent storage mechanism can become clogged, as a result of which the amount of cleaning fluid delivered is reduced.

OBJECT OF THE INVENTION

On the basis of the known devices, the object of the present invention is to create a device to relatively uniformly distribute the smallest possible quantity of cleaning fluid over the width of the cleaning cloth, thereby resulting in more economical operation.

SUMMARY OF THE INVENTION

The present invention teaches that this object can be achieved if, ahead of the cleaning area, corresponding to the cleaning cloth and across the width of the cleaning cloth, there is preferably a feed tube for the cleaning fluid. The feed tube can carry, in a possible embodiment, a felt wetting pad as the cleaning agent storage mechanism. The felt wetting pad can be wetted with cleaning fluid by means of discharge openings in the feed tube, and the felt wetting pad can be pressed relatively briefly against the cleaning cloth. This device can require only a relatively small amount of cleaning fluid to supply the felt wetting pad. By applying the felt wetting pad to the cleaning cloth, a sufficient quantity of cleaning fluid can be transferred to the cleaning cloth and the length of time the felt is pressed against the cleaning cloth can determine the amount of cleaning fluid to be transferred. Therefore, essentially because the cleaning cloth wetted can always be clean, essentially no particles of dirt can be transferred to the felt wetting pad. Therefore, it can also be possible to relatively accurately determine the quantity of cleaning fluid to be dispensed.

In other words, and in accordance with one embodiment, the wetting pad or wick can be pressed against a portion of the cleaning cloth that has not yet reached the cylinder to be cleaned. The dirt and/or ink transferred to the cleaning cloth when the cleaning cloth moves across the cylinder can be downstream of the wetting pad or wick. Therefore the wetting pad or wick can essentially contact the clean cleaning cloth to transfer cleaning fluid to the cleaning cloth, and the wetting pad or wick can substantially remain free of the dirt and/or ink transferred to the cleaning cloth. In a possible embodiment of the present invention, the wick or pad can be a felt wetting pad, that is, made of felt.

In another embodiment of the present invention, the feed tube can have clamps. The felt wetting pad can be clamped in the clamps. Preferably, the pad can cover the discharge openings for the cleaning fluid. When this embodiment is used, the felt wetting pad can be replaced relatively easily. It can be essentially guaranteed that no fluid will unintentionally drip out of the discharge openings for the cleaning fluid, which dripping can result in changes, for example, in the amount of ink to be fed in the inking unit.

In an additional embodiment of the invention, the feed tube can be mounted on pivots by means of swivelling or pivoting levers so that the feed tube can pivot. The feed tube can be made to pivot by means of an actuator. In this manner, the felt wetting pad can be relatively easily placed in contact with the cleaning cloth and can be relatively easily removed from contact with the cleaning cloth.

The present invention also teaches that to change the felt wetting pad, the felt wetting pad can be fastened by means of clamps. When the felt wetting pad becomes worn, a new felt pad strip can be inserted.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

Embodiments of the present invention are schematically illustrated in the accompanying drawings, in which.

DESCRIPTION OF THE PREFERRED EMBODIMENT

Figure 1:
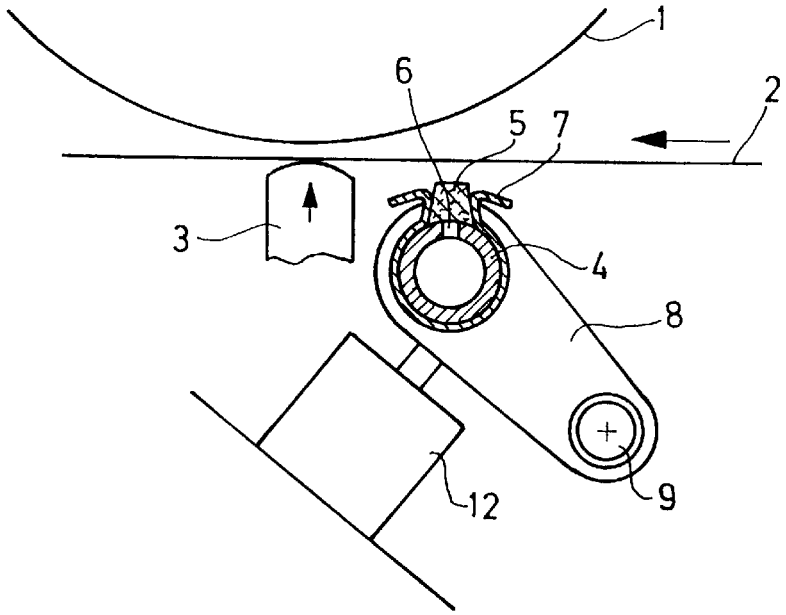
FIG. 1 shows a cross section through a device made in accordance with the present invention.
Figure 3:
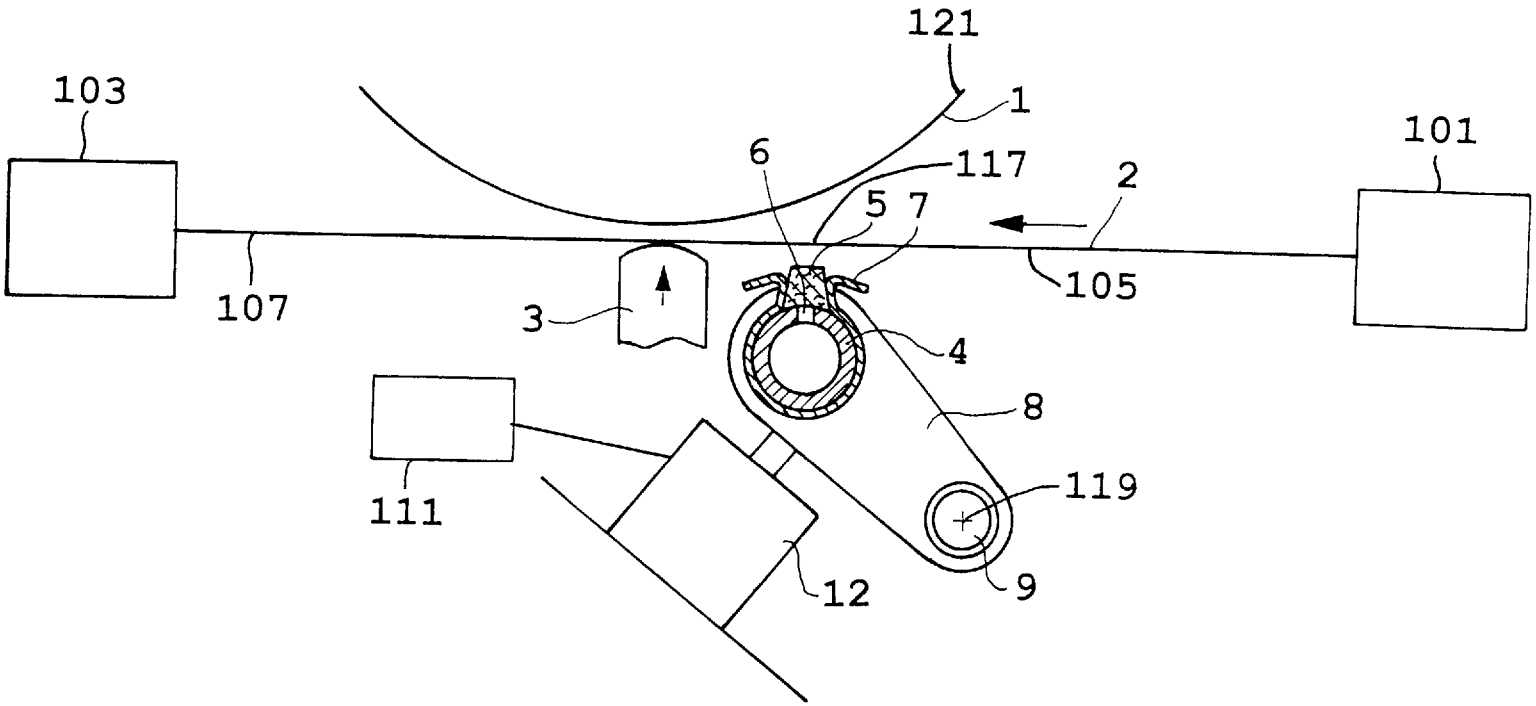
FIG. 3 shows an alternative embodiment of a device made in accordance with the present invention.

As shown in FIG. 1, a cleaning cloth 2 can be unwound from a feed roller 101 (see FIG. 3), and the cleaning cloth 2 can be guided over a cylindrical surface 1 of a cylinder 121 (see FIG. 3). By means of an applicator or application strip 3, the cleaning area of the cleaning cloth 2 can be pressed against the cylinder surface 1, to remove particles of dirt from the cylinder surface 1.

In front of, or in other words, upstream of, the area of the cylinder surface 1 to be cleaned, there can be a feed tube 4 for holding cleaning fluid. The feed tube 4 can extend essentially across the entire width of the cleaning cloth 2. As a cleaning fluid storage mechanism for the relatively uniform distribution of a preferably small amount of cleaning fluid, the feed tube 4 can carry a felt wetting pad 5. The felt wetting pad 5 can cover discharge openings 6 for the cleaning fluid. A precisely measured quantity of cleaning fluid can be fed to the felt wetting pad 5 via the discharge openings 6, thereby wetting the felt wetting pad 5. The felt wetting pad 5 can preferably extend over the width of the cleaning cloth 2, the width of which cleaning cloth 2 can in turn correspond to the length of the cylinder surface 1.

The felt wetting pad 5 can be removably clamped to the feed tube 4 by means of clamps 7. The felt wetting pad 5 can preferably cover the discharge openings 6, so that no cleaning fluid can escape or drip out accidentally.

Figure 2:
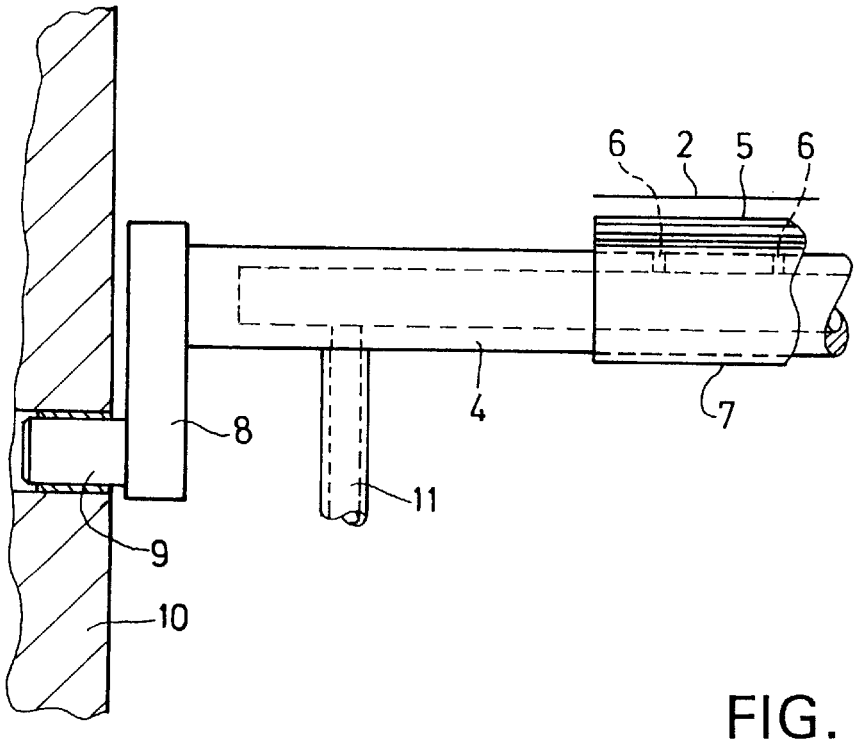
FIG. 2 shows an overhead view of a portion of the device.

As shown in FIGS. 1 and 2, the feed tube 4 can be advantageously mounted so that the feed tube 4 can preferably swivel by means of swivelling levers 8 on pivots 9, which pivots 9 can in turn preferably be located in side pieces 10. The feed tube 4 can be supplied with cleaning fluid by means of a feed line 11 (see FIG. 2). An actuator 12 can preferably be engaged with each swivelling lever 8, so that the felt wetting pad 5 can be placed in contact with the cleaning cloth 2 for a specified length of time, thereby wetting the cleaning cloth 2 so that a cleaning cycle can take place. The actuator 12 can be fastened to a side piece 10. The actuator 12 can be actuated by a respective controller or control program 111 (see FIG. 3). The actuator 12 can be an electric lifting magnet, for example.

In another possible embodiment of the present invention, the actuator 12 can be a solenoid.

In other words, as shown in FIG. 3 for a possible embodiment, the outer cylindrical surface 1 of the cylinder 121 can be cleaned by the cleaning cloth 2 (corresponding features of FIGS. 1–3 have corresponding reference numerals). The cleaning cloth 2 can be unwound from the feed roller 101 and can travel from the feed roller 101, across the cylinder surface 1 to clean the cylinder surface 1. The application strip 3 can press the cleaning cloth 2 against the cylinder surface 1 to remove particles of dirt or ink from the cylinder surface 1.

The cleaning cloth 2 can be unwound from the feed roller 101 and be wound on a take-up roller 103. Because the feed roller 101 and take-up roller 103 are known, a detailed description of these rollers 101 and 103 will not be given. The rollers 101 and 103 can form an arrangement to supply cloth of the cleaning cloth 2 to the cylinder surface 1 from the feed roller 101, and to receive cloth of cleaning cloth 2 onto the take-up roller 103. The cleaning cloth 2 can be divided into an upstream portion 105, which upstream portion 105 has yet to contact the cylinder surface 1, and a downstream portion 107, which downstream portion 107 has contacted and cleaned the cylinder surface 1. The upstream portion 105 can be considered "clean" cloth, and the downstream portion 107 can be considered "dirty" cloth, having possibly picked up dirt and/or ink residue from contact with the cylinder surface 1. The feed roller 101 can be considered to be located upstream of the cylinder surface 1 and the take-up roller 103 can be considered to be located downstream of the cylinder surface 1.

Figure 4:
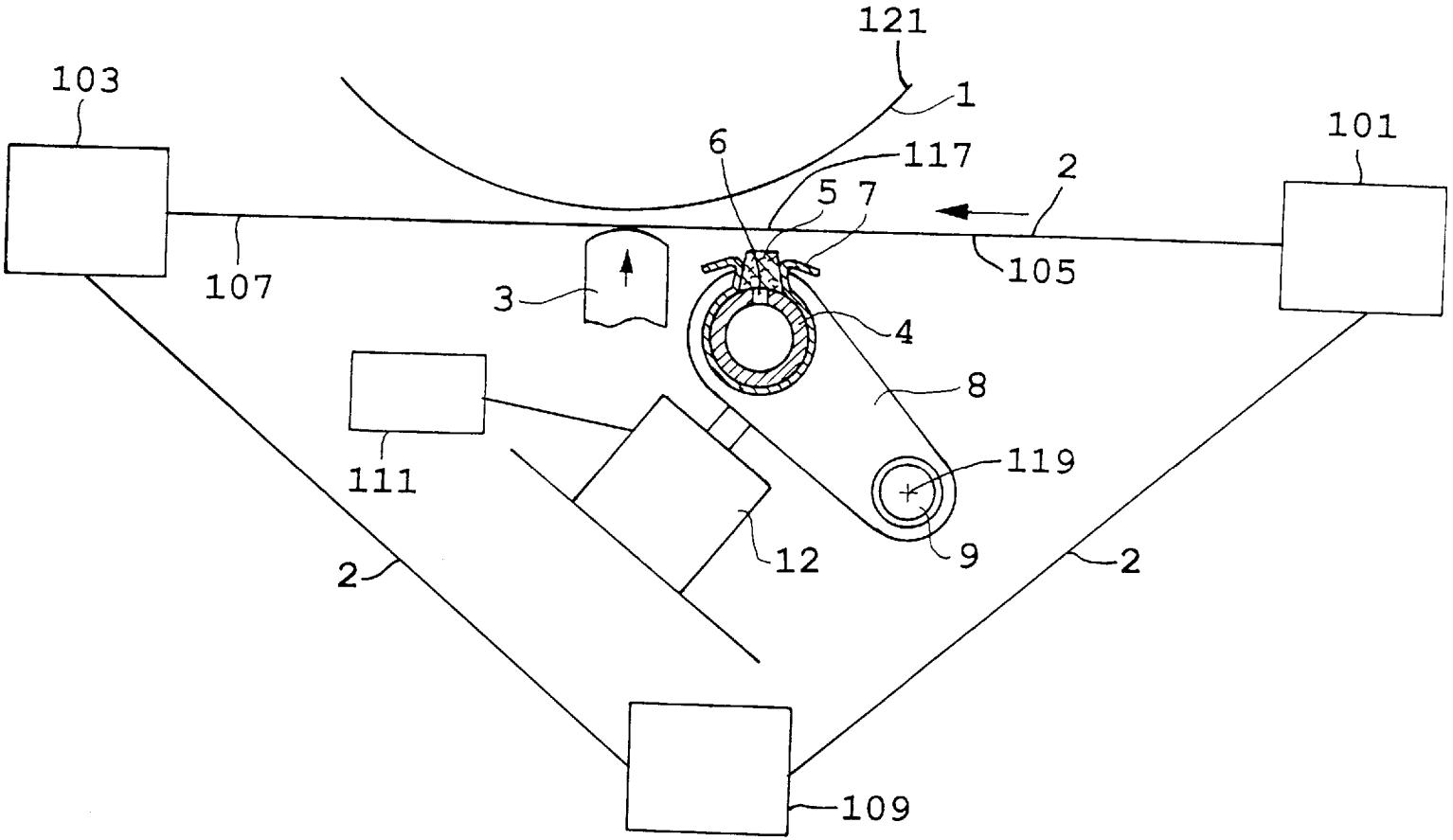
FIG. 4 shows another embodiment of a device made in accordance with the present invention.

In another possible embodiment shown in FIG. 4, the cleaning cloth 2 can be a continuous length or loop of cloth (corresponding features of FIGS. 1–4 have corresponding reference numerals). The cleaning cloth 2 can repeatedly or continuously be passed or looped between the feed roller 101 and the take-up roller 103. The cleaning cloth 2 can clean the cylinder surface 1 after leaving the feed roller 101 and prior to reaching the take-up roller 103 in a manner corresponding to that of the embodiments shown in FIGS. 1–3. The cleaning cloth 2 can then return from the take-up roller 103 to the feed roller 101, preferably via a cloth cleansing device 109. The cleansing device 109 can cleanse the "dirty" cloth and return the cloth to an essentially "clean" cloth to the feed roller 101. Because cleansing devices are known, a detailed description of cleansing device 109 is omitted.

Figure 5:
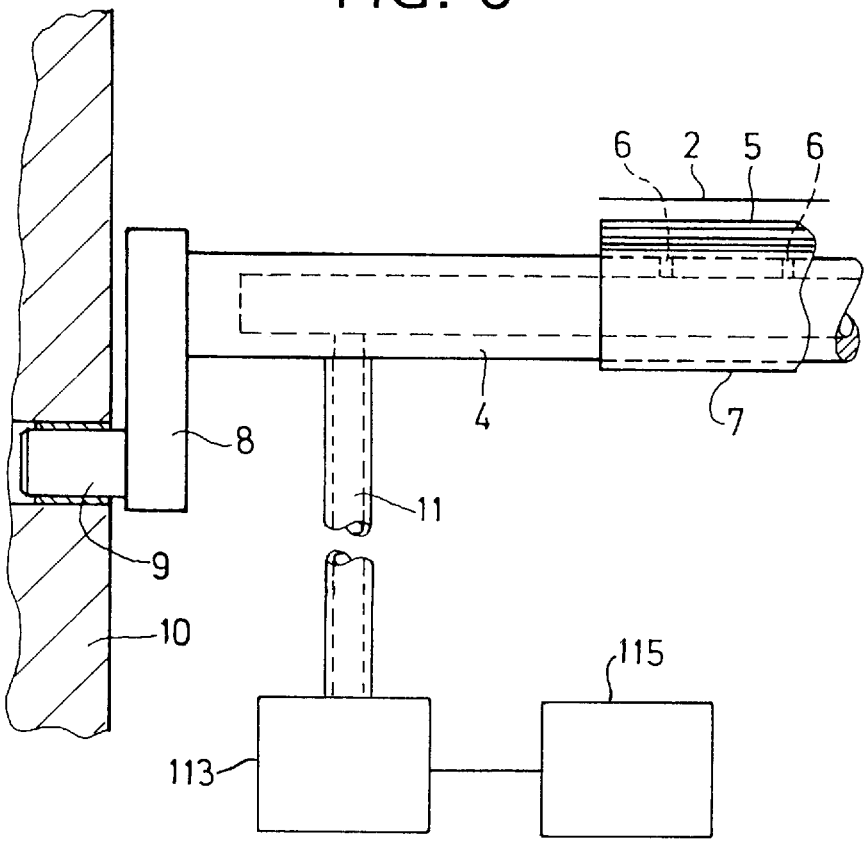
FIG. 5 shows yet another embodiment of a device made in accordance with the present invention.

As shown in the embodiment of FIG. 5, the feed tube 4 can be supplied cleaning fluid from a cleaning fluid reservoir 113 (corresponding features of FIGS. 1–5 have the same reference numerals). A control unit or controller 115 can control or meter the flow of cleaning fluid from the cleaning fluid reservoir 113 to the feed tube 4.

As shown in FIGS. 3 and 4, the feed tube 4 can be located upstream of the application strip 3, and can preferably be disposed between the application strip 3 and the feed roller 101. The feed tube 4 can contain discharge openings 6 to provide preferably the measured discharge of cleaning fluid from the feed tube 4 to the wick or absorbent pad or wetting pad 5. The control unit 115 can in effect control the flow of cleaning fluid from the cleaning fluid reservoir 113 to the wetting pad 5 (see FIG. 5). The wick or wetting pad 5 can preferably be made of felt.

The application strip 3 can be movable to engage and disengage the cleaning cloth 2 against the outer cylindrical surface 1. The feed tube 4 can be located upstream of the application strip 3. The feed tube 4 can be mounted on levers 8. The levers 8 can be pivotally mounted on pivots 9, the pivots 9 locating a corresponding pivoting axis 119. The levers 8 can pivot about the pivots 9 to engage and disengage the wetting pad 5 with the cleaning cloth 2 upstream of the application strip 3. The wetting pad 5 can be pivoted towards the cleaning cloth 2 to contact the cleaning cloth 2 and thereby transfer absorbed or retained cleaning fluid discharged through or metered from the discharge openings 6 to the cleaning cloth 2. The control unit 115 (see FIG. 5) can control the flow of cleaning fluid from the cleaning fluid reservoir 113 (see FIG. 5) to the discharge openings 6 to meter the amount of cleaning fluid transferred to the wetting pad 5. Because the wetting pad 5 preferably contacts the cleaning cloth 2 upstream of the application strip 3, the wetting pad 5 can be substantially prevented from contacting the ink or dirt subsequently transferred from the outer cylinder surface 1 to the cleaning cloth 2 after engaging the cylinder surface 1. The wetting pad 5 can transfer cleaning fluid to the "clean" portion 105 of cleaning cloth 2 and can avoid contact with the "dirty" portion 107 of cleaning cloth 2. The wetting pad 5 can therefore remain free of contamination from ink or dirt transferred from the outer cylindrical surface 1 to the cleaning cloth 2, and the wetting pad 5 can essentially remain clean throughout the operating life of the wetting pad 5.

As shown in FIGS. 3 and 4, the contact of the wetting pad 5 with the cleaning cloth 2 can preferably occur sufficiently upstream from the application strip 3 so that the wetting pad 5 may not press the cleaning cloth 2 against the outer cylindrical surface 1. In effect, the wetting pad 5 may thereby press or bear against an unsupported portion 117 of the cleaning cloth 2. Such an arrangement may be relatively tolerant of the engaged position of the wetting pad 5, because the inherent resiliency or stretch of the cleaning cloth 2 can accommodate variations in the engaged position of the wetting pad 5. Therefore, tolerances in the manufacture and construction of the various component parts may be relaxed in comparison to known devices.

In contrast, if the wetting pad 5 were to directly press the cleaning cloth 2 against the outer cylindrical surface 1, that is, the wetting pad 5 were to press a portion of the cleaning cloth 2 between itself (wetting pad 5) and the cylinder surface 1, the wetting pad 5 could be pressing the cleaning cloth 2 against a relatively unyielding object, that is, cylinder 121. Therefore, excessive movement of the wetting pad 5 towards the outer cylinder surface 1 in such a device may excessively compress the wetting pad 5. The excessive compression of the wetting pad 5 may squeeze or wring out cleaning fluid from the wetting pad 5, and may make control of the metering of cleaning fluid or the volume of cleaning fluid retained by the wetting pad 5 more difficult. Therefore, tolerances in the manufacture and construction of the various component parts may need to be more stringent as compared to a device that does not press the wetting pad 5 directly against the cylinder surface 1.

In other possible embodiments of the present invention, the wetting pad 5 can be made from absorbent material to absorb and retain cleaning fluid from the feed tube 4. The absorbent material can, besides felt, possibly include sponge, resilient resin, fabric, or molleton. Other absorbent materials could be used so as to be compatible with a particular cleaning fluid used, or to satisfy other design requirements of a particular embodiment of the present invention.

One feature of the present invention resides broadly in the device to clean the cylindrical surface of cylinders in rotary printing presses with a cleaning cloth which can be pressed against the cylindrical surface of the cylinder and is wound off a supply roller, whereby to increase the effectiveness of the cleaning action, the cleaning cloth is wetted with a cleaning fluid which can be fed via a cleaning agent storage mechanism, characterized by the fact that located ahead of or in front of or upstream of the area to be cleaned, corresponding to the cleaning cloth 2 there is a feed tube 4 for the cleaning fluid which extends over the entire width of the cleaning cloth 2, which feed line carries a felt wetting pad 5 which acts as the cleaning medium storage mechanism and which is wetted with cleaning fluid by means of discharge openings 6 in the feed tube 4, and that the wetting felt pad 5 can be pressed briefly against the cleaning cloth 2.

Another feature of the invention resides broadly in the device characterized by the fact that the feed tube 4 carries clamps 7 in which the felt wetting pad 5 is clamped so that it covers the discharge openings 6 for the cleaning fluid.

Yet another feature of the invention resides broadly in the device characterized by the fact that the feed tube 4 is mounted on pivots 9 so that it can pivot by means of swivelling levers 8 and is pivoted by means of an actuator 12.

Still another feature of the invention resides broadly in the device characterized by the fact that the felt wetting pad is replaceably fastened in the clamp 7.

Example devices for cleaning cylinder surfaces in printing presses or rotary printing machines which could be adapted for use in the context of the present invention, and which example devices illustrate other components that can possibly be used in conjunction with the present invention, can be disclosed by the following U.S. patents, each assigned to the assignee of the present invention: U.S. Pat. No. 5,174,209, No. 5,375,522, No. 5,365,849 and No. 5,452,660.

Additional example devices for cleaning cylinder surfaces in printing presses which could be adapted for use in the context of the present invention, and which example devices illustrate other components that can possibly be used in conjunction with the present invention can be disclosed by the following U.S. patent applications, each assigned to the assignee of the present invention: Ser. No. 08/515,793, Ser. No. 08/784,402, Ser. No. 08/801,516, filed Feb. 18, 1997 having inventors Andre Geis and Thomas Kraft and titled "Device for Cleaning Outer Cylindrical Surfaces of Cylinders in a Rotary Printing Machine" with Attorney Docket No. NHL-HBD-144 and claiming priority from Federal Republic of Germany Patent Application No. 196 05 957.7 filed on Feb. 27, 1996, Ser. No. 08/822,590, filed Mar. 20, 1997 having inventors Willi Becker, Jens Friedrichs and Frank Kropp and titled "Cleaning Device Provided on a Rotary Printing Machine" with Attorney Docket No. NHL-HBD-145 and claiming priority from Federal Republic of Germany Patent Application No. 196 11 126.9 filed on Mar. 21, 1996, and Ser. No. 08/822,250, filed Mar. 20, 1997 having inventors Willi Becker, Jens Friedrichs and Frank Kropp and titled "Cleaning Device Provided on a Rotary Printing Machine" with Attorney Docket No. NHL-HBD-146 and claiming priority from Federal Republic of Germany Patent Application No. 196 11 125.9 filed on Mar. 20, 1996.

Other examples of cleaning devices for printing presses which may be utilized in accordance with the present invention can be found in the following U.S. patents: U.S. Pat. No. 4,344,361, No. 4,651,644, No. 4,922,821, No. 4,981,078, No. 4,991,507, No. 5,105,740, No. 5,150,650 and No. 5,537,924.

Other examples of actuators, solenoids, controllers and control circuits adaptable for use in the context of the present invention, can be found in the following publications: *Design of Automatic Machinery*, copyright 1985 and authored by Kendrick W. Lentz, Jr., published by Van Nostrand Reinhold Company Inc. and having ISBN number 0-442-26032-6 and Library of Congress Catalog Card Number 84-3513; and *Pneumatics and Hydraulics*, fourth edition, copyright 1984, authored by Harry L. Stewart and revised by Tom Philbin, published by the Bobbs-Merrill Company, Inc. and having ISBN Number 0-672-23412-2.

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein, are hereby incorporated by reference as if set forth in their entirety herein.

The corresponding foreign patent publication applications, namely, Federal Republic of Germany Patent Application No. 196 19 143.2, filed on Apr. 24, 1996, having inventors Joachim Herrmann, Kurt Lötsch, Ralf Degner, and Hendrik Stemmler, and DE-OS 196 19 143.2 and DE-PS 196 19 143.2, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A cleaning apparatus to clean a cylinder of a rotary printing press, said apparatus comprising:

a cleaning cloth;

an arrangement to move the cleaning cloth across the cylinder of the rotary printing press;

said arrangement to move the cleaning cloth comprising an upstream portion being configured and disposed to supply cleaning cloth to the cylinder of the rotary printing press, and a downstream portion being configured and disposed to receive cleaning cloth from the cylinder of the rotary printing press;

an applicator, and means to selectively actuate said applicator to move the cleaning cloth into and out of contact with the cylinder of the rotary printing press;

a feed to feed cleaning fluid to a cleaning cloth;

said feed being disposed between said applicator and said upstream portion of said arrangement;

said feed comprising a wick;

said wick being configured and disposed to absorb and retain cleaning fluid;

a body including said wick, said body being movably mounted to selectively contact said wick with the upstream portion of said cleaning cloth to accurately control the quantity of cleaning fluid to be transferred to said cleaning cloth.

2. The cleaning apparatus according to claim 1, wherein:

said feed comprises a tube; and said tube is configured to carry cleaning fluid within said tube.

3. The cleaning apparatus according to claim 2, wherein:

said tube has a longitudinal axis for being defined substantially parallel with an axis of rotation of a cylinder of a rotary printing press; and said tube has a length configured to be sufficient to extend over substantially the entire width of a cylinder and the entire width of a cleaning cloth disposed between a cylinder and said tube.

4. The cleaning apparatus according to claim 3, wherein:

said tube has an inside surface and an outside surface;

said tube comprises at least one opening;

said at least one opening extends between said inner and outer surfaces of said tube; and said at least one opening is configured and disposed to carry cleaning fluid from within said tube to said wick.

5. The cleaning apparatus according to claim 2, wherein:

said tube comprises at least one clamp;

said at least one clamp is disposed to clamp said wick against said tube; and said wick covers said at least one opening of said tube.

6. The cleaning apparatus according to claim 5, wherein:

said body is movably mounted by at least one lever and one pivot;

said at least one lever is pivotally mounted on said at least one pivot;

said at least one lever is pivotable in a first direction and an opposite second direction;

said tube is attached to said at least one lever;

said device to selectively move said wick comprises an actuator; and said actuator is configured and disposed to selectively pivot said at least one lever in the first direction to move said wick into contact with a cleaning cloth and to pivot said at least one lever in the second direction to move said wick out of contact with a cleaning cloth.

7. The cleaning apparatus according to claim 6, wherein said at least one clamp is configured and disposed to permit replacement of said wick.

8. The cleaning apparatus according to claim 7, wherein:

said upstream portion of said arrangement comprises a supply roller;

said supply roller is configured and disposed to supply cleaning cloth to a cylinder of a rotary printing press; and said wick comprises felt.

9. A method of cleaning a cylinder of a rotary printing press with a cleaning cloth, said method comprising the steps of:

providing a cleaning cloth adjacent a cylinder of a rotary printing press to be cleaned;

moving said cleaning cloth from adjacent said cylinder to a position to contact said cylinder;

moving said cleaning cloth across said cylinder;

said cylinder dividing said cleaning cloth into an upstream portion disposed upstream of said cylinder which upstream portion of said cleaning cloth has not yet contacted said cylinder, and a downstream portion disposed downstream of said cylinder which downstream portion of said cleaning cloth has contacted said cylinder;

said moving of said cleaning cloth from adjacent to said cylinder to a position in contact with said cylinder comprising moving an applicator into contact with said cleaning cloth to displace said cleaning cloth against said cylinder;

providing a wick and a source of cleaning fluid connected to said wick;

accurately controlling the quantity of cleaning fluid to be transferred to said cleaning cloth by providing a body including said wick, said body being movably mounted to selectively contact said upstream portion of said cleaning cloth;

transferring said cleaning fluid from said wick to said upstream portion of said cleaning cloth when said wick is in contact with said cleaning cloth.

10. The method of cleaning according to claim 9, wherein:

said body comprises a tube;

said tube carries cleaning fluid therewithin; and said step of transferring cleaning fluid from said body comprises transferring cleaning fluid from said tube to said upstream portion of said cleaning cloth.

11. The method of cleaning according to claim 10, wherein:

said tube has a longitudinal axis defined substantially parallel with an axis of rotation of said cylinder; and said tube has a length sufficient to extend over substantially the entire width of said cylinder and substantially the entire width of said cleaning cloth disposed between said cylinder and said tube.

12. The method of cleaning according to claim 10, wherein:

said tube has an inside surface and an outside surface disposed about said inside surface;

said tube comprises at least one discharge;

said at least one discharge extends between said inside and outside surfaces of said tube; and said step of transferring cleaning fluid from said tube to said wick comprises transferring cleaning fluid through said at least one discharge.

13. The method of cleaning according to claim 12, wherein:

said tube comprises at least one clamp;

said at least one clamp is disposed to clamp said wick against said tube; and said wick is disposed over said at least one discharge of said tube.

14. The method of cleaning according to claim 13, wherein:

said step of moving said body to contact said upstream portion of said cleaning cloth comprises actuating a lever device to pivot said body to contact said upstream portion of said cleaning cloth;

said moving said body out of contact with said upstream portion of said cleaning cloth comprises deactuating said lever device to pivot said body in a second direction to remove said body from against said upstream portion of said cleaning cloth;

said lever device comprises:

at least one pivot;

at least one lever;

an actuator;

said at least one lever is pivotally mounted on said pivot;

said at least one lever is pivotable in the first and second directions about said pivot; and said actuator is operatively connected to said at least one lever to pivot said at least one lever in the first direction upon actuation of said actuator and to pivot said at least one lever in the second direction upon deactuation of said cylinder;

said tube is attached to said lever;

said step of actuating said lever device comprises actuating said actuator; and said step of deactuating said lever device comprises deactuating said actuator.

15. The method of cleaning according to claim 14, wherein:

said wick structure to absorb and retain cleaning fluid comprises felt;

said clamp is configured and disposed to releasably clamp said wick against said tube; and said method of cleaning further comprises:

clamping an unused wick to said tube; and unclamping a used wick from said tube.

* * * * *